US010413098B2

(12) United States Patent
Petersen et al.

(10) Patent No.: US 10,413,098 B2
(45) Date of Patent: Sep. 17, 2019

(54) IMAGE WITH LIGHT PATTERN

(71) Applicant: PROVIDE COMMERCE, INC., San Diego, CA (US)

(72) Inventors: Deborah Petersen, Chicago, IL (US); David Gregory Smith, III, San Diego, CA (US)

(73) Assignee: PLANETART, LLC, Calabasas, CA (US)

( * ) Notice: Subject to any disclaimer, the term of this patent is extended or adjusted under 35 U.S.C. 154(b) by 0 days.

(21) Appl. No.: 15/295,453

(22) Filed: Oct. 17, 2016

(65) Prior Publication Data

US 2018/0103782 A1 Apr. 19, 2018

(51) Int. Cl.

| | |
|---|---|
| ***A47G 1/06*** | (2006.01) |
| ***G09F 13/22*** | (2006.01) |
| ***G09F 13/04*** | (2006.01) |
| *F21Y 115/10* | (2016.01) |

(52) U.S. Cl.

CPC ..... *A47G 1/0622* (2013.01); *G09F 13/04* (2013.01); *G09F 13/22* (2013.01); *F21Y 2115/10* (2016.08); *G09F 2013/222* (2013.01)

(58) Field of Classification Search

CPC ..... A47G 1/0622; G09F 2013/222; B42D 15/022

See application file for complete search history.

(56) References Cited

U.S. PATENT DOCUMENTS

| | | | | |
|---|---|---|---|---|
| 4,209,824 | A * | 6/1980 | Kaufman | B42D 15/022 362/806 |
| 4,286,399 | A * | 9/1981 | Funahashi | B42D 1/007 40/124.02 |
| 5,782,023 | A * | 7/1998 | Iannantuano | G09F 9/305 362/554 |
| 5,979,097 | A * | 11/1999 | Moore | G09F 1/12 40/124.03 |
| 6,536,149 | B1 * | 3/2003 | Phillips | G09F 1/10 40/768 |
| 2002/0078613 | A1 * | 6/2002 | Roberts | A47F 3/005 40/800 |
| 2006/0070287 | A1 * | 4/2006 | Shaw | A47G 1/06 40/769 |
| 2009/0025266 | A1 * | 1/2009 | Lambert | A47G 1/0605 40/754 |

(Continued)

*Primary Examiner* — Gary C Hoge
(74) *Attorney, Agent, or Firm* — Culhane Meadows PLLC; Robert C. Klinger

(57) ABSTRACT

An example system includes a light layer having a pattern of lights formed on a printed circuit board (PCB) and an image layer positioned over the light layer, the image layer having an image formed thereon. The pattern of lights is visible through the image formed on the image layer. In another example, a system includes a set of lighting template including at least two lighting templates, each lighting template including a pattern of lights formed on a printed circuit board (PCB), wherein each lighting template in the set of lighting templates includes a different pattern of lights, and a set of image templates including an image formed thereon, wherein each image template corresponds to a lighting template selected from the set of lighting templates. An image template from the set of image templates is positioned over a corresponding lighting template from the set of lighting templates.

11 Claims, 5 Drawing Sheets

(56) References Cited

U.S. PATENT DOCUMENTS

| | | | | |
|---|---|---|---|---|
| 2010/0281719 | A1* | 11/2010 | Driessen | B42D 15/022 40/124.02 |
| 2013/0000164 | A1* | 1/2013 | Shah | B42D 15/022 40/124.02 |
| 2013/0255115 | A1* | 10/2013 | Hughes | B42D 15/022 40/124.02 |
| 2013/0305572 | A1* | 11/2013 | Pochatek | B42D 15/022 40/124.02 |

* cited by examiner

300

400

500

600

IMAGE WITH LIGHT PATTERN

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND

Images are often framed with lights. Often the lights are provided to be projected onto the image for improved displaying of the image. For example, pictures or paintings are often displayed in frames hung on a wall. A light may be provided above the frame to provide sufficient illumination of the image.

BRIEF DESCRIPTION OF THE DRAWINGS

For a more complete understanding of various examples, reference is now made to the following descriptions taken in connection with the accompanying drawings in which.

DETAILED DESCRIPTION

Various examples described below provide images which may be enhanced or decorated with a pattern of lights that may appear embedded or part of the image. The pattern of lights may be positioned to accentuate particular parts of an image or to provide a pattern in addition to the image. In various examples, an image is positioned above a light layer which includes a printed circuit board (PCB) with a pattern of lights formed thereon.

Figure 1:
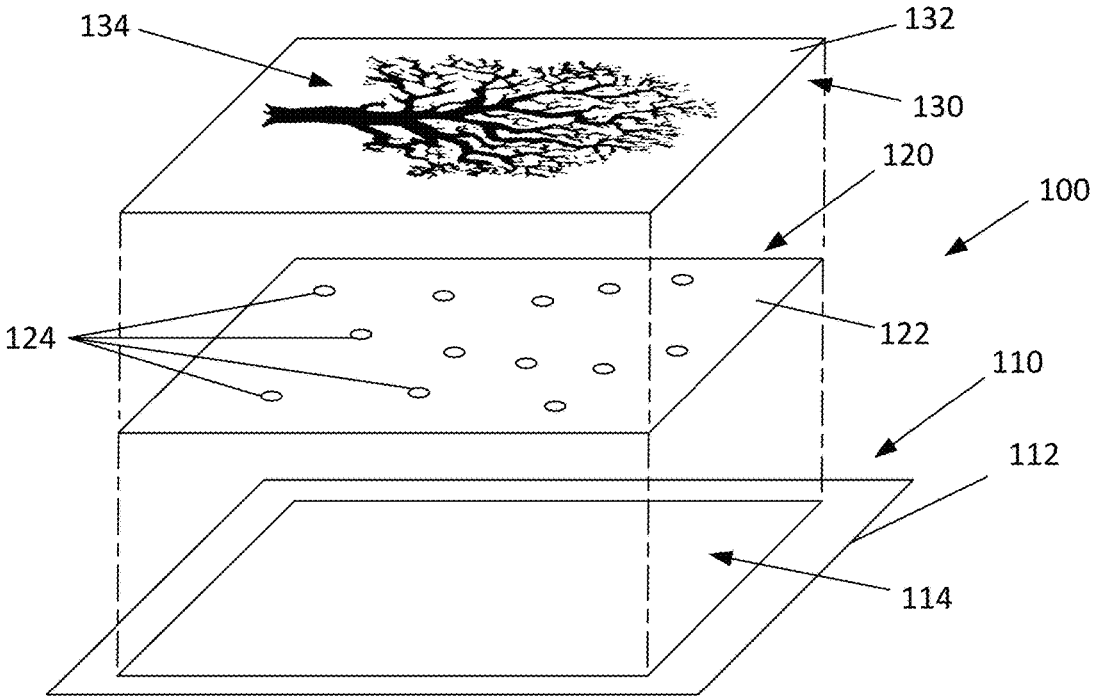
FIG. 1 illustrates an exploded view of an example system.

Referring first to FIG. 1, an exploded view of an example system 100 is illustrated. The example system includes a frame 110, a light layer 120 and an image layer 130. The light layer 120 and the image layer 130 are positioned on the frame 110 to form the system 100 to provide an image with a pattern of lights formed within the image, as described in greater detail below.

In the example system 100 of FIG. 1, the frame 110 includes a frame body 112 having a central portion 114. The central portion 114 may be hollowed or recessed from an outer portion of the frame body 112. The frame body 112 and the central portion 114 may be sized to accommodate a desired sized image, for example. Further, frame body 112 of the example frame 110 may be provided with a thickness sufficient to accommodate the thickness of the light layer 120 and the image layer 130 therein.

In various examples, the frame 110 may be formed of any of a variety of materials. For example, the frame 110 may be formed of metal (e.g., aluminum), plastic, wood or a combination of such materials.

In the example system 100 of FIG. 1, the light layer 120 includes a light board 122 with a plurality of light sources 124 positioned at various locations throughout the board. In various examples, the light sources 124 are positioned to form a desired pattern of lights. Further, the light board 122 may contain circuitry, power supply and any other components that may be useful for operation of the light layer 120. Example light layers 120 are described below in further detail with reference to FIGS. 7 and 8.

Referring again to the example system 100 of FIG. 1, the example image layer 130 includes an image medium 132 with an image 134 formed thereon. In various examples, the image medium 132 may be formed on any of a variety of materials, such as various forms of print media. For examples, the image medium 132 may be formed of a paper or cloth material. Further, the image 134 formed on the image medium 132 may include any image desired. Various examples images are described below with reference to FIGS. 3-6.

Figure 2:
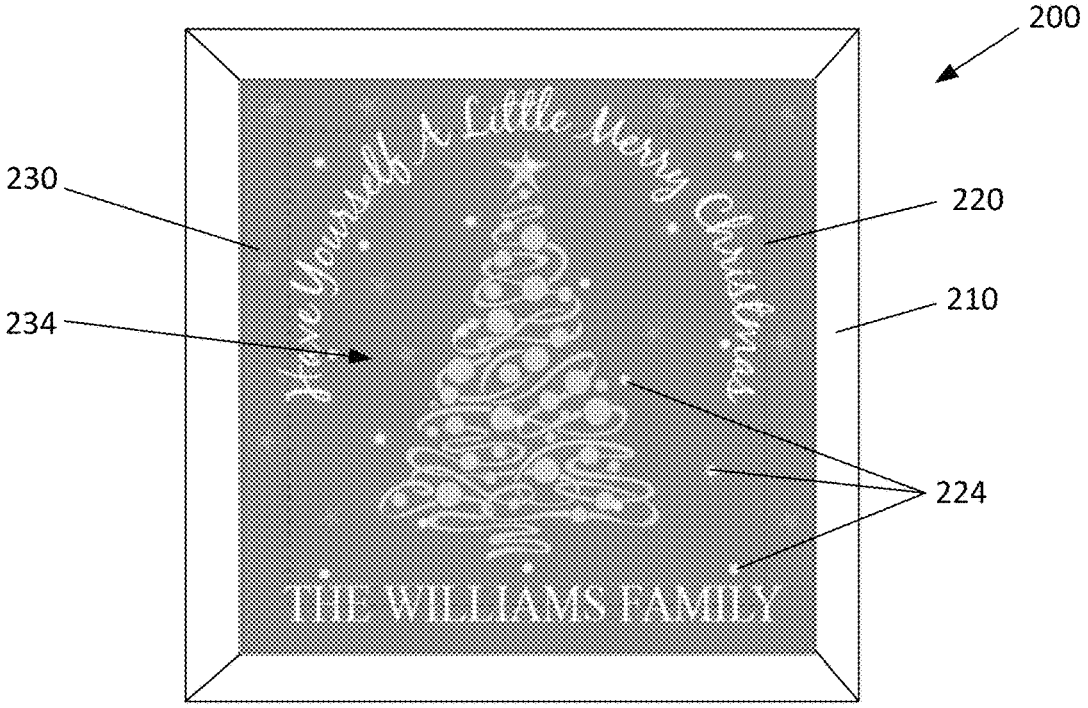
FIG. 2 illustrates a frontal view of an example assembled system.

Referring now to FIG. 2, a frontal view of an example system 200 is illustrated in fully assembled form. The example system 200 may be similar to the example system 100 described above with reference to FIG. 1. In this regard, the example system 200 includes a frame 210, a light layer 220 (indicated by the dotted line in FIG. 2), and an image layer 230.

As noted above, the frame 210 may be formed of any of a variety of materials including metal, plastic, wood or a combination of such materials. Further, the frame may be formed to accommodate an image layer 230 of various sizes including, but not limited to 8 inches by 8 inches, for example. Of course, various other sizes may be accommodated and are contemplated within the scope of the present disclosure.

The image layer 230 of the example system 200 of FIG. 2 includes an image 234 formed thereon. For example, as illustrated in the example of FIG. 2, the image layer 230 may include an image 234 with a holiday theme. Example images may be personalized with a name of an individual or a family for example.

As noted above, the example system 200 of FIG. 2 includes a light layer 220 positioned below the image layer 230. Similar to the light layer 120 described above with reference to FIG. 1, the light layer 220 of FIG. 2 includes a plurality of lights 224. The plurality of lights 224 form a pattern of lights. As shown in FIG. 2, when the example system 200 is assembled and the lights 224 are turned on, the lights 224 are visible through the image 234 formed on the image layer 230. In various examples, the lights 224 are positioned within the image 234 or embedded within the image 234. Thus, in various examples, the lights 224 may appear to be part of the image 234 itself. Thus, the lights 224 may enhance the image 234.

Figure 3:
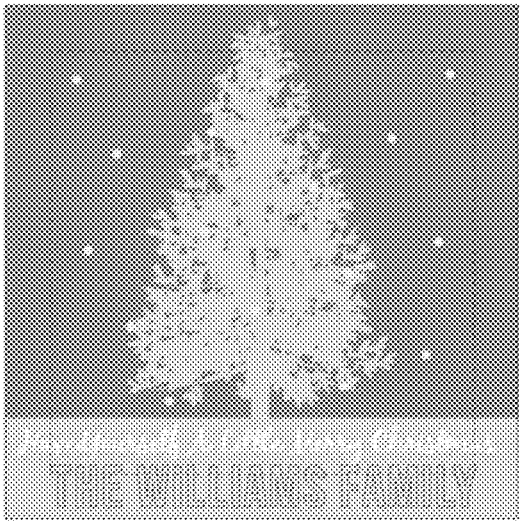
FIGS. 3-6 illustrate example images or image templates.
Figure 4:
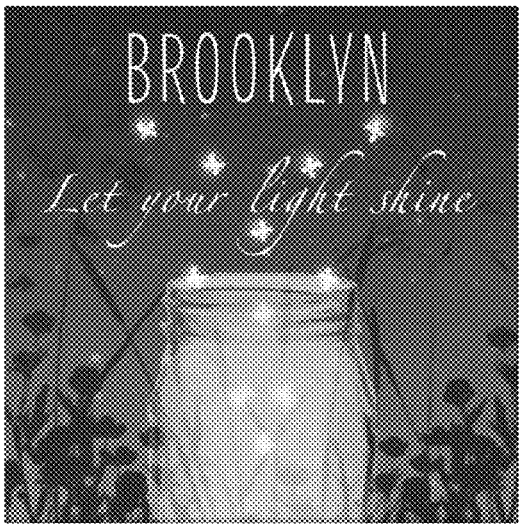
Figure 5:
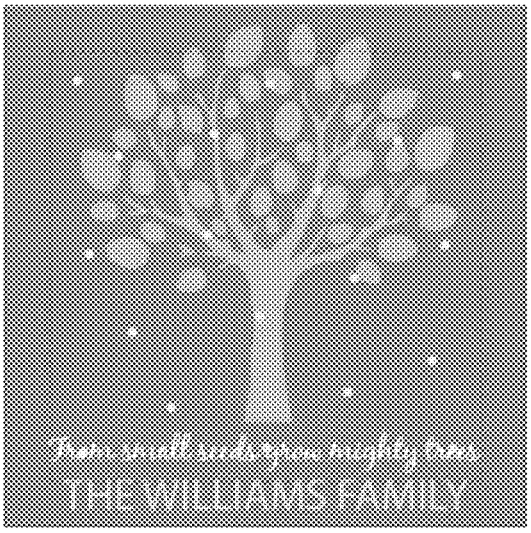
Figure 6:
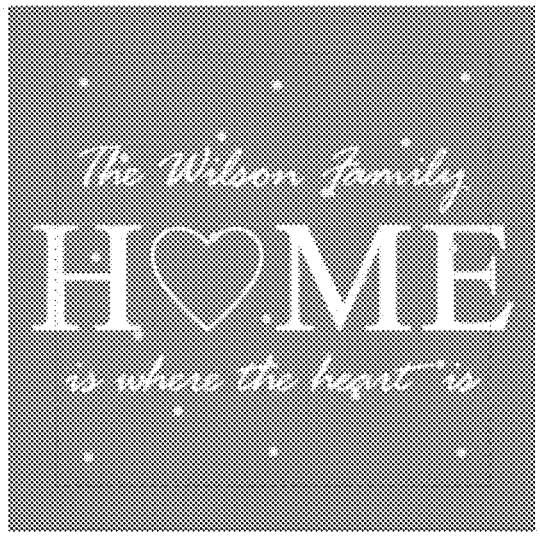

Referring now to FIGS. 3-6, various example images are illustrated. For example, FIG. 3 illustrates an image 300 formed with an image template with a Christmas tree theme. The image 300 may be formed by adding to the image template a name, such as "THE WILLIAMS FAMILY", as illustrated in the example image 300 of FIG. 3. Similarly, FIG. 4 illustrates an example image 400 is formed by adding a name (e.g., "BROOKLYN" in FIG. 3) to another image template. FIG. 5 illustrates an example image 500 formed by adding a name (e.g., "THE WILLIAMS FAMILY") to a template with a family tree theme, and FIG. 6 illustrates an example image 600 formed by adding a name to another template.

Figure 7:
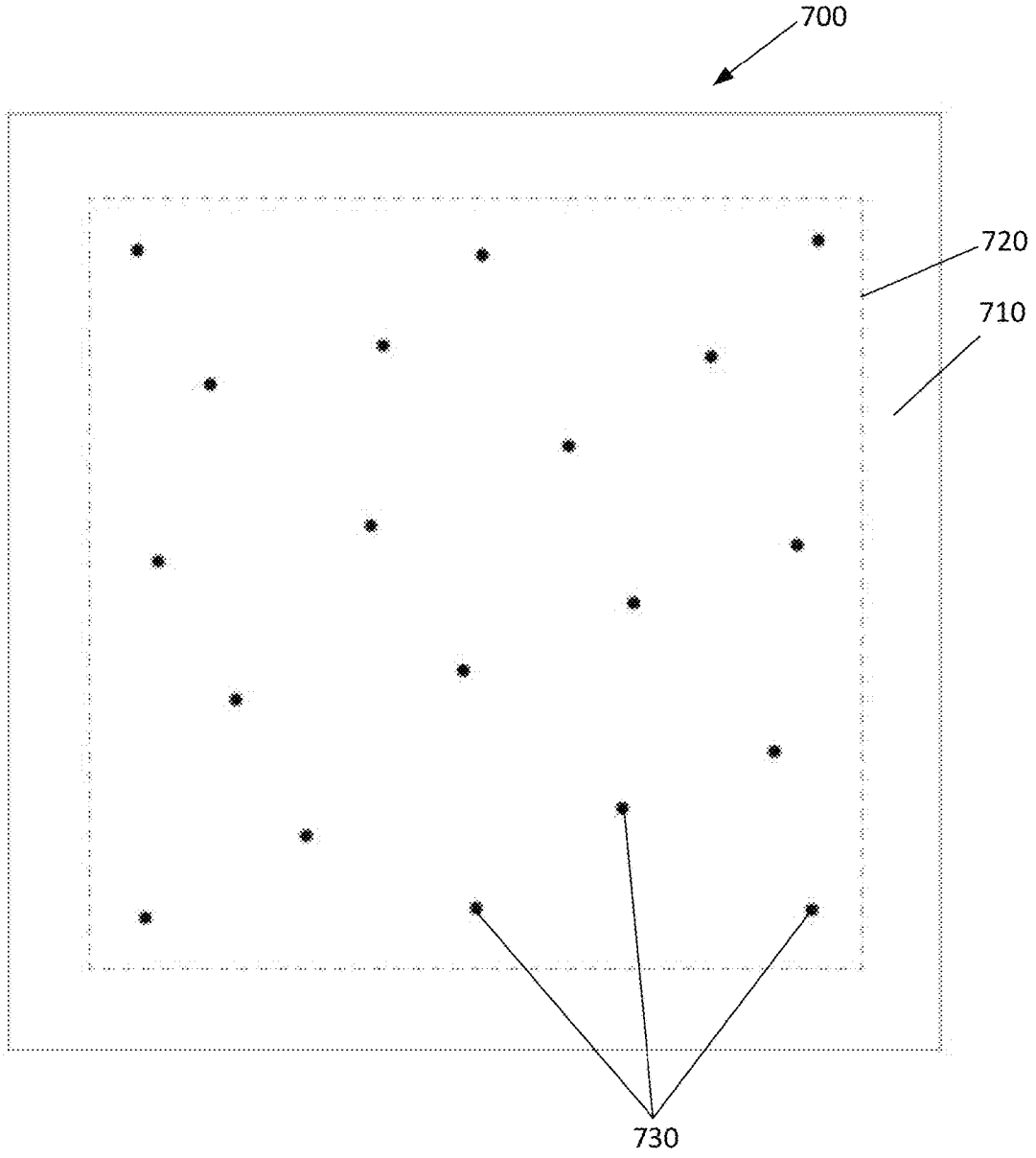
FIG. 7 illustrates a frontal view of an example lighting template.

Referring now to FIG. 7, a frontal view of an example light layer 700 is illustrated. The example light layer 700 may be similar to the light layer 120 described above with reference to FIG. 1. In this regard, the example light layer 700 includes a light board 710 with a light region 720. The light region 720 may be defined as a portion of the light board 710 that lies beneath a certain portion of the image layer of an example system. In this regard, the example light layer 700 includes a plurality of lights 730 that are positioned within the light region 720. As noted above, the lights 730 are positioned to form a desired pattern.

Figure 8:
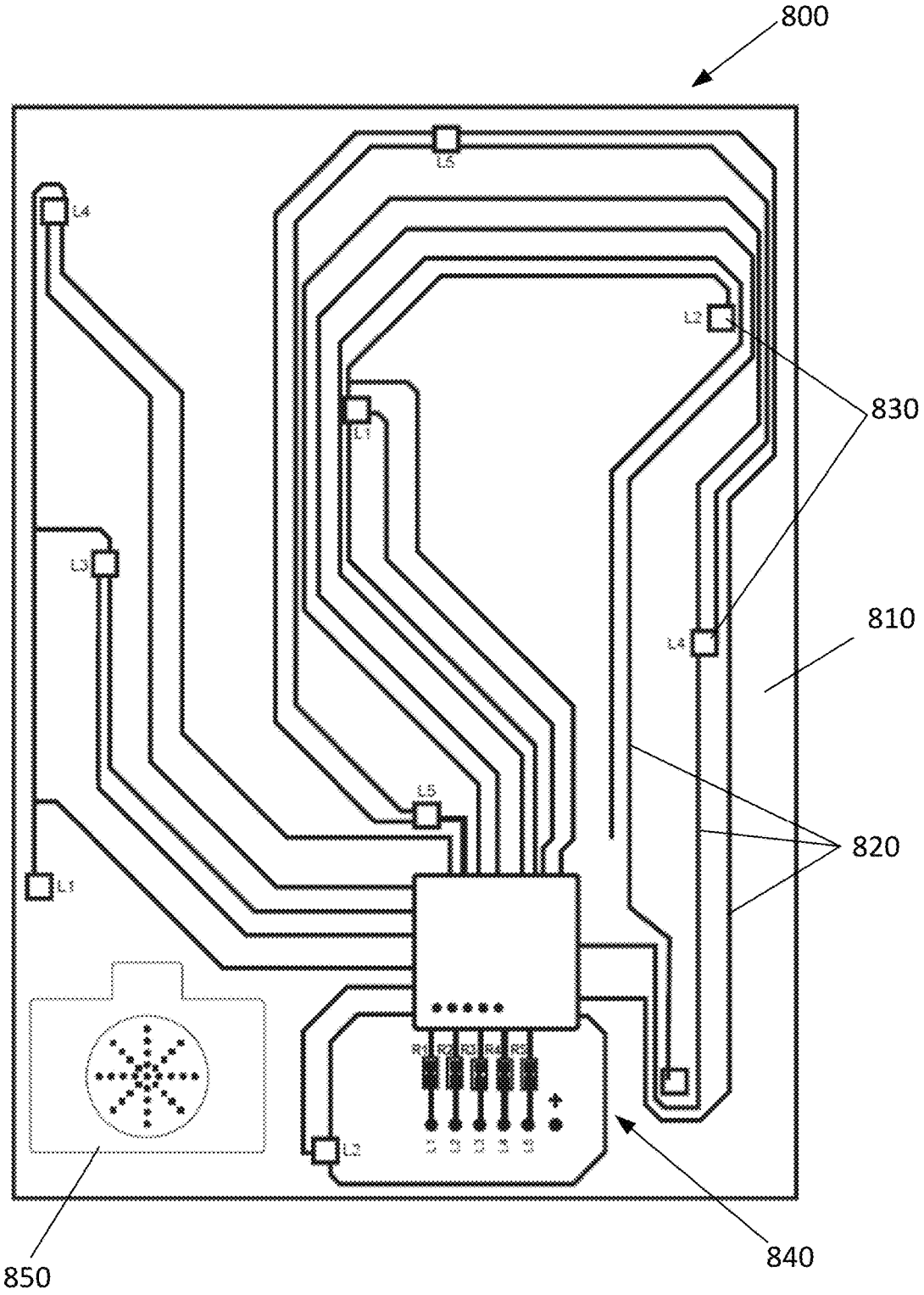
FIG. 8 illustrates a rear of an example lighting template.

Referring now to FIG. 8, a rear view of an example light layer 800 is illustrated. The example light layer 800 includes a light board 810. In the example light layer 800 of FIG. 8, the light board 810 is a printed circuit board (PCB). In this regard, the light board 810 may be formed of a non-conductive substrate. The example light board 810 includes electrical lines 820, or traces, that are printed on the light board 810. The printed electrical lines 820 may be formed of in a variety of manners that are well known to those skilled in the art and are beyond the scope of the present disclosure.

In the example light layer 800 of FIG. 8, the PCB forming the light board 810 includes a pattern of lights 830. The lights 830 may include light sources that extend to the opposite side of the light board 810. Thus, the lights 830 are visible on the front side of the light board 810 where an image layer may be positioned.

In various examples, the lights 830 are formed with light emitting diodes (LEDs) that are connected to the printed electrical lines 820. Further, in the example of FIG. 8, the light board 810 is provided with a control portion 840. The control portion 840 may include various components including, but not limited to, a controller (e.g., firmware, software or hardware) and a power supply. The control portion 840 is also connected to the printed electrical lines 820. Thus, the lights 830 may be electrically connected to the control portion 840 via the printed electrical lines 820. In various examples, the light board 810 may also be provided with an audio portion 850 which may include, for example, a speaker. The audio portion 850 may also be connected to the control portion 840 through, for example, printed electrical lines (not shown in FIG. 8 for purposes of clarity).

By using a printed circuit board, example systems may be made with improved efficiency and reliability. For example, a light layer with a printed circuit board may be manufactured with lower labor costs than a light layer which requires wires to be routed to light sources which may be mounted on a board.

As noted above with reference to FIGS. 7 and 8, the lights 730, 830 are positioned to form a desired pattern. In one example, the example light layer 700 of FIG. 7 may be one template from a set of light templates. In this regard, each light template (e.g., the light template or light layer 700) of the set of light templates may include a different or unique pattern of lights. Thus, each light template of the set of light templates includes lights positioned in different locations within the light region 720.

In various examples, a system, such as the example systems 100 and 200 described above with reference to FIGS. 1 and 2, may be formed by selecting various templates for the image layer and the light layer. Thus, in one example, a set of image templates, such as the templates used in the images 300-600 of FIGS. 3-6, may be provided. Similarly, a set of lighting templates, such as the lighting template or light layer 700 described above with reference to FIG. 7, may be provided. Each image template, such as the templates used in the images 300-600 of FIGS. 3-6, may correspond to one lighting template from the set of lighting templates. For example, the image template used for the image 300 of FIG. 3 may correspond to the lighting template 700 of FIG. 7, while the image template used for the image 400 of FIG. 4 may correspond to a different lighting template. Thus, each lighting template may include a light pattern to specifically enhance one or more image templates from the set of image templates. An example process 900 of forming systems using the set of lighting templates and the set of image templates is described below with reference to FIG. 9.

Figure 9:
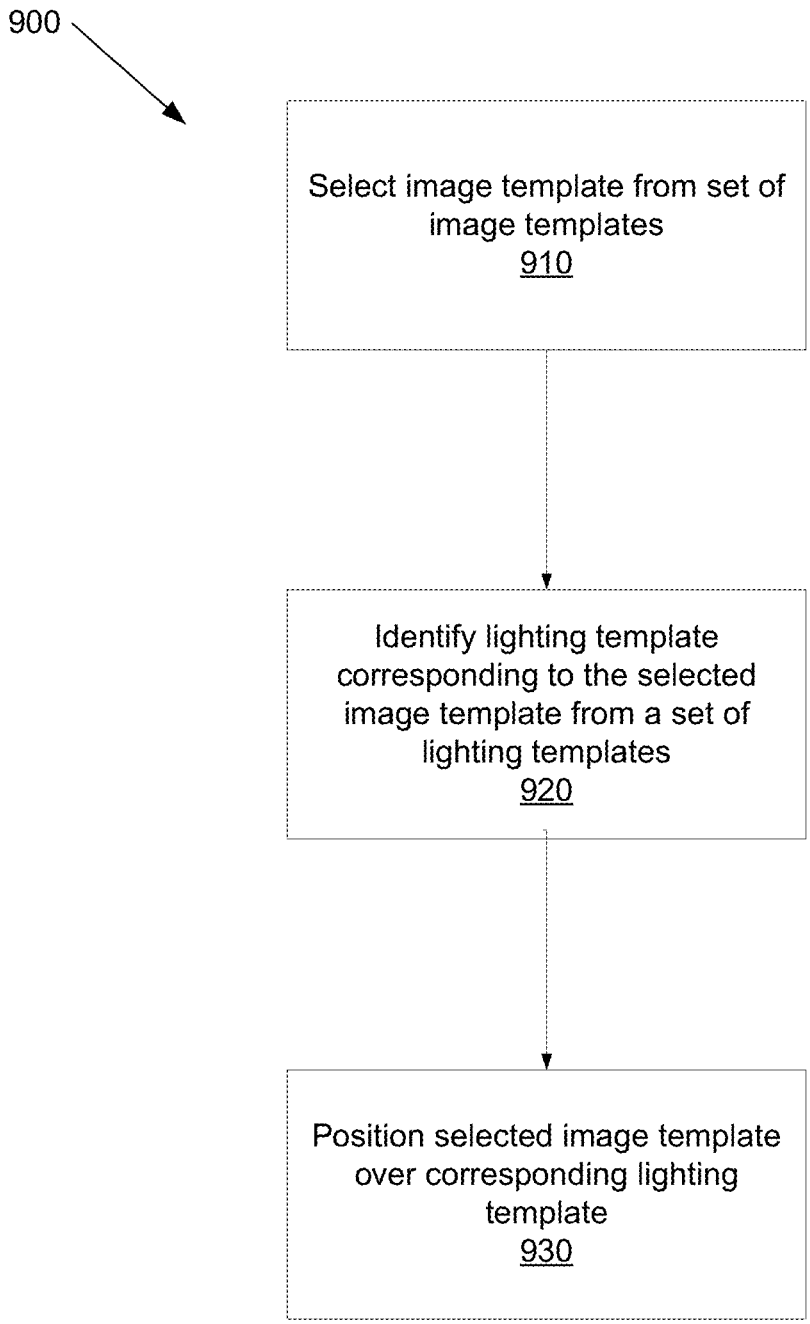
FIG. 9 illustrates an example process.

Referring now to FIG. 9, the example process 900 includes selecting an image template from a set of image templates (block 910). Each image template in the set of image templates may have an image formed thereon. For example, as described above, various image templates may be used to form the images 300-600 illustrated in FIGS. 3-6.

Referring again to FIG. 9, the example process 900 includes identifying a lighting template corresponding to the selected image template from a set of lighting templates (block 920). The set of lighting templates may include at least two lighting templates, and each lighting template may include a pattern of lights formed on a printed circuit board (PCB). As noted above, an example lighting template may be similar to the light layer illustrated in FIG. 7, and may include a light board formed of a PCT, as described above with reference to FIG. 8. Each lighting template in the set of lighting templates includes a different pattern of lights. Thus, lights may be positioned in different locations in each lighting template in the set of lighting templates.

The example process 900 further includes positioning the selected image template over the corresponding lighting template (block 930). As illustrated in the example of FIG. 2, the pattern of lights formed on the corresponding lighting template is visible through an image formed on the image template.

Thus, various examples described herein provide systems with a pattern of lights that may enhanced or decorate an image. The pattern of lights is formed on a light layer which includes a printed circuit board (PCB). An image layer positioned above the light layer includes an image which is enhanced by the pattern of lights.

The various examples set forth herein are described in terms of example block diagrams, flow charts and other illustrations. Those skilled in the art will appreciate that the illustrated examples and their various alternatives can be implemented without confinement to the illustrated examples. For example, block diagrams and their accompanying description should not be construed as mandating a particular architecture or configuration.

What is claimed is:

1. A system, comprising:

a light layer having a pattern of lights formed on a printed circuit board (PCB); and an image layer positioned over the light layer, the image layer having an image formed thereon, wherein the pattern of lights is visible through the image formed on the image layer, wherein the light layer and the image layer are substantially of equal size, and wherein the pattern of lights of the light layer is not associated with any features of the image of the image layer and is randomly distributed throughout the image layer.

2. The system of claim 1, wherein the PCB includes printed electrical lines leading to light sources forming the pattern of lights.

3. The system of claim 2, wherein the light sources are light emitting diodes (LEDs).

4. The system of claim 1, further comprising:

a frame, wherein the light layer and the image layer are mounted on the frame.

5. A system, comprising:

a set of lighting templates including at least two lighting templates, each lighting template including a pattern of lights formed on a printed circuit board (PCB), wherein each lighting template in the set of lighting templates includes a different pattern of lights; and a set of image templates including an image formed thereon, wherein each image template corresponds to a lighting template selected from the set of lighting templates, wherein an image template from the set of image templates is positioned over a corresponding lighting template from the set of lighting templates, wherein the pattern of lights is visible through the image formed on the image template, wherein each lighting template in the set of lighting templates and each image template in the set of image templates are substantially of equal size, and wherein the pattern of lights of the light templates is not associated with any features of the images of the image template and is randomly distributed throughout the image layer.

6. The system of claim 5, wherein the PCB includes printed electrical lines leading to light sources forming the pattern of lights.

7. The system of claim 6, wherein the light sources are light emitting diodes (LEDs).

8. A method, comprising:

selecting an image template from a set of image templates, each image template in the set of image templates having an image formed thereon; and identifying a lighting template corresponding to the selected image template from a set of lighting templates, wherein the set of lighting templates includes at least two lighting templates, each lighting template including a pattern of lights formed on a printed circuit board (PCB), wherein each lighting template in the set of lighting templates includes a different pattern of lights; and positioning the selected image template over the corresponding lighting template, wherein the pattern of lights formed on the corresponding lighting template is visible through an image formed on the image template, wherein each lighting template in the set of lighting templates and each image template in the set of image templates are substantially of equal size, and wherein the pattern of lights of the light templates is not associated with any features of the images of the image template and is randomly distributed throughout the image layer.

9. The method of claim 8, wherein the PCB includes printed electrical lines leading to light sources forming the pattern of lights.

10. The method of claim 9, wherein the light sources are light emitting diodes (LEDs).

11. The method of claim 8, further comprising:

mounting the selected image template and the corresponding lighting template on a frame.

* * * * *